US010584286B2

(12) United States Patent
Jones et al.

(10) Patent No.: US 10,584,286 B2
(45) **Date of Patent: *Mar. 10, 2020**

(54) HYDROGEN SULFIDE SCAVENGERS

(71) Applicant: Ecolab USA Inc., St. Paul, MN (US)

(72) Inventors: Ian Michael Jones, Sugar Land, TX (US); Jennifer L. Sorrells, Houston, TX (US); Joseph L. Stark, Katy, TX (US)

(73) Assignee: ECOLAB USA INC., St. Paul, MN (US)

( * ) Notice: Subject to any disclaimer, the term of this patent is extended or adjusted under 35 U.S.C. 154(b) by 275 days.

This patent is subject to a terminal disclaimer.

(21) Appl. No.: 15/235,846

(22) Filed: Aug. 12, 2016

(65) Prior Publication Data

US 2017/0066976 A1 Mar. 9, 2017

Related U.S. Application Data

(60) Provisional application No. 62/215,542, filed on Sep. 8, 2015.

(51) Int. Cl.
*C10G 29/22* (2006.01)

(52) U.S. Cl.
CPC ..... *C10G 29/22* (2013.01); *C10G 2300/202* (2013.01)

(58) Field of Classification Search
CPC ..... C10G 29/22; C10G 29/24; C10G 29/28; C10G 2300/202
See application file for complete search history.

(56) References Cited

U.S. PATENT DOCUMENTS

| | | | | |
|---|---|---|---|---|
| 169,949 | A | 12/1875 | Brown et al. | |
| 2,776,870 | A | 1/1957 | Fischer | |
| 2,878,294 | A * | 3/1959 | Kress | C07C 43/11 252/364 |
| 2,900,350 | A * | 8/1959 | Kirkpatrick | C10G 33/04 516/171 |
| 3,071,433 | A | 1/1963 | Dunn | |
| 3,458,444 | A | 7/1969 | Shepherd et al. | |
| 3,519,691 | A * | 7/1970 | Von Portatius | C07C 41/56 560/238 |
| 3,855,210 | A | 12/1974 | Keller | |
| 3,880,784 | A | 4/1975 | Wagner et al. | |
| 3,888,668 | A | 6/1975 | Keller | |
| 4,036,942 | A | 7/1977 | Sibeud et al. | |
| 4,107,106 | A | 8/1978 | Dunleavy et al. | |
| 4,195,151 | A | 3/1980 | Dunleavy et al. | |
| 4,327,092 | A | 4/1982 | Collington et al. | |
| 4,342,756 | A | 8/1982 | Collington et al. | |
| 4,410,436 | A | 10/1983 | Holstedt et al. | |
| 4,412,928 | A | 11/1983 | Holstedt et al. | |
| 4,557,843 | A | 12/1985 | Holstedt et al. | |
| 4,623,474 | A | 11/1986 | Holstedt et al. | |
| 4,627,930 | A | 12/1986 | Holstedt et al. | |
| 4,629,579 | A | 12/1986 | Jessup et al. | |
| 4,629,580 | A | 12/1986 | Holstedt et al. | |
| 4,657,686 | A | 4/1987 | Holstedt et al. | |
| 4,680,127 | A | 7/1987 | Edmondson | |
| 4,724,099 | A | 2/1988 | Holstedt et al. | |
| 4,748,011 | A | 5/1988 | Baize | |
| 4,756,842 | A | 7/1988 | Holstedt et al. | |
| 4,760,133 | A | 7/1988 | Niwa et al. | |
| 4,801,729 | A | 1/1989 | Holstedt et al. | |
| 4,892,670 | A | 1/1990 | Mendelson | |
| 5,213,680 | A | 5/1993 | Kremer et al. | |
| 5,304,361 | A | 4/1994 | Parisi | |
| 5,700,438 | A | 12/1997 | Miller | |
| 6,048,968 | A | 4/2000 | Etzbach et al. | |
| 6,267,913 | B1 | 7/2001 | Marder et al. | |
| 6,544,492 | B1 | 4/2003 | DeBerry | |
| 6,608,228 | B1 | 8/2003 | Cumpston et al. | |
| 6,942,037 | B1 | 9/2005 | Arnold et al. | |
| 7,078,005 | B2 | 7/2006 | Smith et al. | |
| 7,235,194 | B2 | 6/2007 | Cumpston et al. | |
| 7,438,877 | B2 | 10/2008 | Salma et al. | |
| 7,781,187 | B2 | 8/2010 | Gasper et al. | |
| 8,173,635 | B2 | 5/2012 | Jimenez et al. | |
| 8,197,722 | B2 | 6/2012 | Marder et al. | |
| 8,367,697 | B2 | 2/2013 | Jimenez et al. | |

(Continued)

FOREIGN PATENT DOCUMENTS

| | | | |
|---|---|---|---|
| CA | 1257606 | A | 7/1989 |
| CA | 1283397 | C | 4/1991 |

(Continued)

OTHER PUBLICATIONS

Kreulen, H., et al., "Selective removal of $H_2S$ from sour gases with microporous membranes. Part II. A liquid membrane of water-free tertiary amines," *J Membrane Sci*, 82:185-197 (1993).

International Search Report and Written Opinion from PCT App. No. PCT/US2016/046813, dated Nov. 23, 2016 (10 pages).

International Search Report and Written Opinion from PCT App. No. PCT/US2016/046832, dated Nov. 23, 2016 (9 pages).

Bakke, Jan M. and Buhaug, Janne B. "Hydrogen Sulfide Scavenging by 1,3,5-Triazinanes. Comparison of the Rates of Reaction." Industrial & Engineering Chemistry Research (2004), vol. 43, pp. 1962-1965.

(Continued)

*Primary Examiner* — Michelle Stein

(74) *Attorney, Agent, or Firm* — Eric D. Babych; Barnes & Thornburg LLP

(57) ABSTRACT

Scavenging compounds and compositions useful in applications relating to the production, transportation, storage, and separation of crude oil and natural gas are disclosed. Also disclosed herein are methods of using the compounds and compositions as scavengers, particularly in applications relating to the production, transportation, storage, and separation of crude oil and natural gas.

15 Claims, No Drawings

(56) References Cited

U.S. PATENT DOCUMENTS

| | | | | |
|---|---|---|---|---|
| 8,597,549 | B2 | 12/2013 | Cumpston et al. | |
| 8,734,637 | B2 | 5/2014 | Taylor | |
| 9,347,010 | B2 | 5/2016 | Gonzalez et al. | |
| 9,468,882 | B2 | 10/2016 | Laroche et al. | |
| 9,523,045 | B2 | 12/2016 | Harrington et al. | |
| 2002/0185634 | A1 | 12/2002 | Marder et al. | |
| 2004/0086443 | A1 | 5/2004 | Schield et al. | |
| 2004/0096382 | A1* | 5/2004 | Smith | C10L 3/10 423/226 |
| 2004/0110984 | A1 | 6/2004 | Cumpston et al. | |
| 2005/0238556 | A1 | 10/2005 | Pakulski et al. | |
| 2007/0154980 | A1 | 7/2007 | Gasper et al. | |
| 2008/0283804 | A1 | 11/2008 | Cumpston et al. | |
| 2009/0291937 | A1 | 11/2009 | Jimenez et al. | |
| 2011/0031165 | A1* | 2/2011 | Karas | C10G 29/22 208/48 AA |
| 2011/0155646 | A1 | 6/2011 | Karas et al. | |
| 2011/0220551 | A1 | 9/2011 | Taylor | |
| 2012/0149680 | A1 | 6/2012 | Jimenez et al. | |
| 2012/0012507 | A1 | 9/2012 | Compton et al. | |
| 2012/0241361 | A1* | 9/2012 | Ramachandran | C10G 19/02 208/232 |
| 2013/0172623 | A1 | 7/2013 | Kaplan | |
| 2013/0240409 | A1 | 9/2013 | Subramaniyam | |
| 2013/0274426 | A1 | 10/2013 | Sugiura et al. | |
| 2013/0299734 | A1* | 11/2013 | Yang | C10G 29/22 252/180 |
| 2014/0041893 | A1 | 2/2014 | Adams et al. | |
| 2014/0166282 | A1 | 6/2014 | Martinez et al. | |
| 2014/0166288 | A1 | 6/2014 | Bailey et al. | |
| 2014/0166289 | A1 | 6/2014 | Martinez et al. | |
| 2014/0190870 | A1 | 7/2014 | Lehrer et al. | |
| 2014/0209510 | A1 | 7/2014 | Harrington et al. | |
| 2014/0234191 | A1 | 8/2014 | Laroche et al. | |
| 2015/0175877 | A1 | 6/2015 | Shindgikar et al. | |
| 2016/0312141 | A1 | 10/2016 | Rana et al. | |
| 2017/0066977 | A1 | 3/2017 | Rana et al. | |
| 2018/0221811 | A1 | 8/2018 | Vorberg et al. | |

FOREIGN PATENT DOCUMENTS

| | | | |
|---|---|---|---|
| CN | 1757796 | A | 4/2006 |
| CN | 1814595 | A | 8/2006 |
| CN | 1309868 | C | 4/2007 |
| CN | 101037541 | A | 9/2007 |
| CN | 100503595 | C | 6/2009 |
| CN | 102993047 | A | 3/2013 |
| CN | 103012199 | A | 4/2013 |
| CN | 103018237 | A | 4/2013 |
| CN | 103691277 | A | 4/2014 |
| CN | 102993047 | B | 9/2014 |
| CN | 103018237 | B | 9/2014 |
| DE | 219030 | | 12/1908 |
| DE | 236746 | | 11/1910 |
| DE | 1092002 | | 11/1960 |
| DE | 2729918 | A1 | 1/1979 |
| DE | 3301822 | A1 | 8/1983 |
| DE | 3925256 | A1 | 1/1991 |
| DE | 19820400 | A1 | 11/1999 |
| EP | 0202600 | A2 | 11/1986 |
| EP | 411409 | A1 | 2/1991 |
| EP | 955342 | B1 | 7/2001 |
| EP | 1363985 | B1 | 8/2007 |
| EP | 2364768 | A1 | 9/2011 |
| GB | 1107057 | A | 3/1968 |
| GB | 1107244 | A | 3/1968 |
| GB | 2114144 | B | 7/1985 |
| JP | S58129059 | A | 8/1983 |
| JP | H01271416 | A | 10/1989 |
| JP | H03099038 | A | 4/1991 |
| JP | 2000026746 | A | 1/2000 |
| JP | 2006219506 | A | 8/2006 |
| JP | 2009522406 | A | 6/2009 |
| JP | 2011038215 | A | 2/2011 |
| JP | 5441053 | B2 | 3/2014 |
| PL | 144233 | B1 | 4/1988 |
| RU | 2118649 | C1 | 9/1998 |
| RU | 2197605 | | 1/2003 |
| RU | 2220756 | | 1/2004 |
| RU | 2246342 | C1 | 2/2005 |
| RU | 2305123 | | 8/2007 |
| RU | 2372341 | | 11/2009 |
| RU | 2008122310 | A | 12/2009 |
| RU | 2404175 | C2 | 11/2010 |
| RU | 2466175 | C2 | 11/2010 |
| RU | 2418036 | C1 | 5/2011 |
| RU | 2009143509 | A | 5/2011 |
| RU | 2470987 | C1 | 12/2012 |
| RU | 2490311 | C1 | 8/2013 |
| WO | WO 9007467 | | 7/1990 |
| WO | WO 98/21521 | A1 | 5/1998 |
| WO | WO 02/051968 | A1 | 7/2002 |
| WO | WO 2007/078926 | A2 | 7/2007 |
| WO | WO 2008/027721 | A1 | 3/2008 |
| WO | WO 2008/155333 | A1 | 12/2008 |
| WO | WO 2014/025577 | A1 | 2/2014 |
| WO | WO 2012/086189 | A1 | 5/2014 |
| WO | WO 2016/030262 | | 3/2016 |
| WO | WO 2016/100224 | A2 | 6/2016 |
| WO | WO 2018/001629 | | 1/2018 |
| WO | WO 2018/001630 | | 1/2018 |
| WO | WO 2018/001631 | | 1/2018 |

OTHER PUBLICATIONS

International Search Report and Written Opinion for International Application No. PCT/US2014/013818, 9 pages (dated May 28, 2014).

International Search Report and Written Opinion for International Application No. PCT/US2016/028534, 12 pages (dated Jun. 30, 2016).

International Preliminary Report on Patentability for International Application No. PCT/US2016/046813, 7 pages (dated Mar. 22, 2018).

International Search Report and Written Opinion for International Application No. PCT/US2017/044099, 11 pages (dated Oct. 26, 2017).

Kozyukov, V.P. and V.F. Mironov. Journal of General Chemistry of the USSR, Translated from Russian. New York: Consultants Bureau, 1982, pp. 1222-1229.

Pudovik et al. Journal of General Chemistry of the USSR, Translated from Russian. New York: Consultants Bureau, 1990, pp. 407-408.

STN search, 60 pages (Mar. 4, 2016).

STN search, 3 pages (Mar. 6, 2018).

European Search Report for European Application No. 16783814.3, 8 pages (dated Oct. 2, 2018).

Benn, M.H., et al., "Cytotoxic compounds. I. p-(N,N-di-2-chloroethyl)- and p-(N,N-di-2-bromoethylamino)thiophenol," Journal of the Chemical Society, 2800-10 (1958).

Bennett, E. O., "Corrosion inhibitors as preservatives for metal-working fluids—ethanolamines," Lubrication Engineering, 35(3):137-44 (1979).

Bradshaw, Jerald S., "Synthesis of macrocylic acetals containing lipophilic substituents," Tetrahedron, 43(19):4271-6 (1987).

Clerici, A., et al., "A New One-Pot, Four-Component Synthesis of 1,2-Amino Alcohols: TiCl3/t-BuOOH-Mediated Radical Hydroxymethylation of Imines," Organic Letters, 10(21):5063-5066 (2008).

Friedli, A., et al., "A convenient synthetic entry into aldehydes with extended conjugation," Tetrahedron, 53(8):2717-2730 (1997).

Friedli, A., et al., "A convenient synthetic entry into aldehydes with extended conjugation," Tetrahedron, 53(18):6233-6234 (1997).

Guo, C., et al., "Synthesis of new aromatic aldehydes bearing nitrogen mustard derivatives and haloalkylpiperazinyl," Youji Huaxue, 25(3):308-312 (2005).

International Search Report and Written Opinion for International Application No. PCT/US2018/041758, 11 pages (dated Sep. 28, 2018).

(56) References Cited

OTHER PUBLICATIONS

Li, F., et al., "Synthesis of γ-N-arylideneaminopropyl-2-methyl-6-phenyl-1,3-dioxa-6-aza-2-silacyclooctanes," Synthetic Communications, 31(23):3715-3720 (2001).
Ma, H., et al., "A novel synthesis of side-chain electro-optic polyimides with high azo chromophore density," European Polymer Journal, 34(8):1125-1132 (1998).
Massin, J., et al., "Near-Infrared Solid-State Emitters Based on Isophorone: Synthesis, Crystal Structure and Spectroscopic Properties," Chemistry of Materials, 23(3):862-873 (2011).
Nishiyama, T., et al., "Synthesis and NMR spectra of 6-phenyl-5,6,7,8-tetrahydro-4H-1,3,6-dioxazocines," Journal of Heterocyclic Chemistry, 23(1):69-71 (1986).
Shen, S., et al., "Mechanistic study of the oxidation of N-phenyldiethanolamine by bis(hydrogen periodato)argentate(III) complex anion," Transition Metal Chemistry, 32(2):167-171 (2007).
"Sul-free H2S & Acid Gas Eliminator," 6 pages, undated, but to the best of undersigned attorney's belief and knowledge is believed to be prior to the filing date of this application.
Yin, D., et al., "Synthesis of a novel organic nonlinear optical molecule MC-FTC," Huaxue Xuebao, 62(5):518-522 (2004).
Zhao, Y., et al., "A highly selective colorimetric chemodosimeter for fast and quantitative detection of hydrogen sulfide," Analyst (Cambridge, United Kingdom), 137(23):5576-5580 (2012).
Zhou, L., et al., "NLO Polymers Containing Anionic Chromophore," Journal of Macromolecular Science, Part A: Pure and Applied Chemistry, A42(10):1423-1434 (2005).
Zhou, L., et al., "Novel crosslinked nonlinear optical materials based on cellulose diacetate," Journal of Applied Polymer Science, 100(4):2832-2837 (2006).
CAS Registry No. 120-07-0, entered STN: Nov. 16, 1984, 2 pages.
CAS Registry No. 3077-12-1, entered STN: Nov. 16, 1984, 2 pages.
CAS Registry No. 30525-89-4, entered STN: Nov. 16, 1984, 2 pages.
CAS Registry No. 50-00-0, entered STN: Nov. 16, 1984, 2 pages.
Amararene, Fatiha et al., "Study of Hydrogen Sulfide Absorption with Diethanolamine in Methanolic Aqueous Solutions" Chemical Engineering Transactions (2016) 52: 259-264.
Mandal, B.P. et al, "Selective absorption of $H_2S$ from gas streams containing $H_2S$ and $CO_2$ into aqueous solutions of N-methyldiethanolamine and 2-amino-2-methyl-1-propanol" Separation and Purification Technology (2004) 35: 191-202.
Mandal, B.P. et al, "Simultaneous absorption of carbon dioxide and hydrogen sulfide into aqueous blends of 2-amino-2-methyl-1-propanol and diethanolamine" Chemical Engineering Science (2005) 60: 6438-6451.
Al Sasi, Basil Omar et al., "Removal of sulfur from sulfur-bearing natural gas to produce clean jet fuel" Petroleum Science and Technology (2016) 34(17-18): 1550-1555.
STN Search, 23 pages (Aug. 29, 2018).
Riesenfeld, F.C. et al., "Tertiary ethanolamines more economical for removal of $H_2S$ and carbon dioxide" Oil & Gas Journal (1986) 61-65.
Unknown, "Naval Research Laboratory" Naval Research Laboratory, Jan. 1, 1900, pp. 29-30.
Walker, J. Frederic, "Formaldehyde" Reinhold Publishing Corporation, 1964, Ed. Third Edition; p. 264.

* cited by examiner

HYDROGEN SULFIDE SCAVENGERS

TECHNICAL FIELD

The present disclosure relates generally to scavengers of sulfur-based species, and more particularly to aldehydes and compounds derived from condensing mono-alcohols with aldehydes as scavengers of hydrogen sulfide and/or mercaptans.

BACKGROUND

The removal of sulfur-based species from liquid or gaseous hydrocarbon streams is a long-standing problem in many industries. Hydrogen sulfide is a significant problem in the oil industry, particularly in the drilling, production, transportation, storage, and processing of crude oil, naphtha, fuel, and distillate oils. The same problems exist in the natural gas industry.

The presence of sulfur-containing compounds such as hydrogen sulfide can result in the deposition of sulfur containing salts which cause plugging and corrosion of transmission pipes, valves, regulators and other process equipment. Hydrogen sulfide is also toxic and, therefore, desirable to be removed. Even flared natural gas needs to be treated to avoid acid rain generation due to $SO_x$ formation. Also, in the manufactured gas or coke making industries, coal-gas emissions containing unacceptable levels of hydrogen sulfide are commonly produced from destructive distillation of bituminous coal.

Since hydrogen sulfide has an offensive odor, and fluids such as petroleum products and natural gas contain it, such fluids are often called "sour." Treatments to lower hydrogen sulfide are often referred to as "sweetening" processes. When a particular compound is used to remove or lower $H_2S$ and mercaptans, it is called scavenging agent.

Despite the availability of scavengers for use in the oil and gas industry, there still exists a need for improved compounds, compositions and methods for removing sulfur-based species from liquid and gas streams. Such improvements include nitrogen-free scavengers and scavengers with increased dispersion into the sour hydrocarbon.

SUMMARY

In one aspect, a method of sweetening a fluid, includes treating the fluid with an oil-soluble hemiformal of formula (I) or an aldehyde compound of formula (II):

$$R^1—O—[—CH_2—O—]_x—H; \quad (I)$$

$$R^2—(CO)H; \quad (II)$$

wherein $R^1$ is $C_4$-$C_{30}$ linear or branched alkyl; x is from 1 to 105; and $R^2$ is $C_4$-$C_{30}$ linear or branched alkyl; wherein when x is 1, $R^1$ is not n-butyl.

In some embodiments, the fluid is treated with the hemiformal of formula (I), and x is from 1 to 12. In some embodiments, x is from 1 to 5. In some embodiments, x is 1. In some embodiments, x is 2.

In some embodiments, $R^1$ is linear $C_5$-$C_{30}$ alkyl. In some embodiments, $R^1$ is branched $C_4$-$C_{30}$ alkyl. In some embodiments, $R^1$ is $C_5$-$C_{20}$ alkyl. In some embodiments, $R^1$ is $CH_2$—$CH(CH_3)_2$. In some embodiments, $R^1$ is tridecyl. In some embodiments, $R^1$ is 2-ethylhexyl.

In some embodiments, the fluid is treated with the aldehyde compound of formula (II). In some embodiments, $R^2$ is linear $C_4$-$C_{20}$ alkyl. In some embodiments, $R^2$ is branched $C_4$-$C_{20}$ alkyl.

In some embodiments, the fluid is selected from crude oil, naphtha, fuel, and distillate oils.

In some embodiments, the method also includes adding one or more additional components, each component independently selected from the group consisting of asphaltene inhibitors, paraffin inhibitors, corrosion inhibitors, emulsifiers, dispersants, emulsion breakers, hydrogen sulfide scavengers, gas hydrate inhibitors, surfactants, solvents, and combinations thereof. In some embodiments, the surfactant or dispersant is selected from the group consisting of alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl ($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

In some embodiments, the method also includes adding an odorant.

In some embodiments, the fluid is produced or used in a coal-fired process, a waste-water process, a farm, a slaughter house, a land-fill, a municipality waste-water plant, a coking coal process, or a biofuel process.

DETAILED DESCRIPTION

Disclosed herein are hydrogen sulfide and/or mercaptan scavenging compounds and compositions, methods of using said compounds and compositions, and processes for their preparation. The compounds and compositions are particularly useful in the control of hydrogen sulfide and/or mercaptan emissions from crude oil based, natural gas based, and coal based products and processes. The compounds and compositions are applicable to both upstream and downstream processes. The scavenging compounds and compositions, optionally blended with non-aqueous solvents, are useful in a wide range of climates and under a wide range of process conditions.

The disclosed processes for preparing the compounds and compositions of the invention are economic, waste free, and provide said compounds in quantitative yields. In certain embodiments, the compounds and compositions may be obtained in anhydrous form, thereby providing use in processes where it is desirable to minimize water content (e.g., in an oil production process such as those where the oil temperature is greater than 100° C.). Producing the compounds and compositions in anhydrous form also allows for reduced transportation costs. The anhydrous compounds and compositions can optionally be blended with hydrophilic solvents (e.g., alcohols, glycol, polyols) for non-aqueous applications.

1. Definition of Terms

Unless otherwise defined, all technical and scientific terms used herein have the same meaning as commonly understood by one of ordinary skill in the art. In case of conflict, the present document, including definitions, will control. Various methods and materials are described below, although methods and materials similar or equivalent to those described herein can be used in practice or testing in view of this disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

Unless expressly stated to the contrary, use of the term "a" is intended to include "at least one" or "one or more." For example, "a compound" is intended to include "at least one compound" or "one or more compounds."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

As used herein, the term "consisting essentially of" means that the methods and compositions may include additional steps, components, ingredients or the like, but only if the additional steps, components and/or ingredients do not materially alter the basic and novel characteristics of the claimed methods and compositions.

The term "alkyl," as used herein, refers to a linear or branched hydrocarbon radical, a defined number of carbon atoms (i.e., 4, 5, 6, 7, 8, 9, 10, 11, 12, 13, 14, 15, 16, 17, 18, 19, 20, 21, 22, 23, 24, 25, 26, 27, 28, 29, and 30 carbons). Alkyl groups include, but are not limited to, n-butyl, isobutyl, secondary-butyl, and tertiary-butyl.

The term "sweetening," as used herein, may refer to a process that removes sulfur species from a gas or liquid. The sulfur species may include hydrogen sulfide and mercaptans.

The term "sour gas," as used herein, may refer to a gas that includes significant amounts of sulfur species, such as hydrogen sulfide and/or mercaptans.

The term "sour liquid" or "sour fluid," as used herein, may refer to a liquid that includes significant amounts of sulfur species, such as hydrogen sulfide and/or mercaptans.

2. Compounds

Compounds disclosed herein include scavengers of sulfur-based species, such as hydrogen sulfide and mercaptans. In one aspect, compounds disclosed herein are of formula (I):

$$R^1—O—[—CH_2—O—]_x—H \quad (I)$$

where $R^1$ is $C_4$-$C_{30}$ linear or branched alkyl and x is from 1 to 105. In some embodiments, when x is 1, $R^1$ is not linear $C_4$ alkyl (n-butyl).

The unit [—$CH_2$—O—] represents a formaldehyde (i.e. when x is 1) and paraformaldehyde (when x is greater than 1). Thus, the molecular weight of the compounds of formula I depends upon both the selection of $R^1$ as well as number of hemiformal units present. In some embodiments, x is selected from 1 to 12. In some embodiments, x is from 1 to 5. In some embodiments, x is from 1 to 4. In some embodiments, x is from 1 to 3. In some embodiments, x is from 1 to 2. In some embodiments, x is 1. In some embodiments, x is 2. In some embodiments, x is 3. In some embodiments, x is 4. In some embodiments, x is 5. In some embodiments, x is greater than 5. In some embodiments, x is less than 100.

Applicant has found that using mono-functionalized, primary alcohols result in products that have increased oil solubility over conventional scavengers. In some embodiments, $R^1$ is branched $C_4$-$C_{30}$ alkyl. Where $R^1$ is branched $C_4$-$C_{30}$ alkyl, the branching is not located geminal to the carbon with the hydroxyl group. In some embodiments, $R^1$ is linear $C_5$-$C_{30}$ alkyl. In some embodiments, $R^1$ is iso-butyl. In some embodiments, $R^1$ is n-pentyl. In some embodiments, $R^1$ is branched $C_5$-$C_{30}$ alkyl. Where $R^1$ is branched $C_5$-$C_{30}$ alkyl, the branching is not located geminal to the carbon with the hydroxyl group. In some embodiments, $R^1$ is linear $C_6$-$C_{30}$ alkyl. In some embodiments, $R^1$ is branched $C_6$-$C_{30}$ alkyl. Where $R^1$ is branched $C_6$-$C_{30}$ alkyl, the branching is not located geminal to the carbon with the hydroxyl group. In some embodiments, $R^1$ is linear or branched $C_6$-$C_{20}$ alkyl. In some embodiments, $R^1$ is linear $C_6$-$C_{20}$ alkyl. In some embodiments, $R^1$ is branched $C_6$-$C_{30}$ alkyl. Where $R^1$ is branched $C_6$-$C_{30}$ alkyl, the branching is not located geminal to the carbon with the hydroxyl group. In some embodiments, $R^1$ is linear or branched $C_8$-$C_{20}$ alkyl. In some embodiments, $R^1$ is linear $C_8$-$C_{20}$ alkyl. In some embodiments, $R^1$ is branched $C_6$-$C_{20}$ alkyl. Where $R^1$ is branched $C_6$-$C_{20}$ alkyl, the branching is not located geminal to the carbon with the hydroxyl group. In some embodiments, $R^1$ is tridecyl. In some embodiments, $R^1$ is 2-ethylhexyl.

In some embodiments, the compounds of formula I are not corrosive to steel, and other iron alloys.

The compounds of formula I are prepared by mixing an alkyl alcohol of the formula $R^1$—OH, where $R^1$ is an alkyl group among the options described above, with formaldehyde in the presence of an acid catalyst, such as dodecyl benzene sulfonic acid. The resulting hemiformal may have a single hemiformal unit where a single unit of formaldehyde reacts with the alkyl alcohol or multiple hemiformal units where multiple units of formaldehyde react with the alkyl alcohol and resulting hemiformals.

The compounds of formula (I) may have flash points above 110° F. In some embodiments, the flash point is above 120° F. In some embodiments, the flash point is above 125° F. In some embodiments, the flash point is above 130° F. In some embodiments, the flash point is above 135° F. In some embodiments, the flash point is above 140° F. In some embodiments, the flash point is above 141° F. In some embodiments, the flash point is above 145° F. In some embodiments, the flash point is above 150° F. In some embodiments, the flash point is above 155° F. In some embodiments, the flash point is above 160° F. In some embodiments, the flashpoint is sufficiently high, 141° F. that they may be shipped as non-flammable materials.

In another aspect, compounds disclosed herein are of formula (II):

$$R^2—(CO)H; \quad (II)$$

where $R^2$ is $C_4$-$C_{30}$ linear or branched alkyl. In some embodiments, $R^2$ is $C_4$-$C_{30}$ linear alkyl. In some embodiments, $R^2$ is $C_4$-$C_{30}$ branched alkyl. In some embodiments, $R^2$ is $C_4$-$C_{20}$ linear alkyl. In some embodiments, $R^2$ is $C_4$-$C_{20}$ branched alkyl. In some embodiments, $R^2$ is $C_5$-$C_{20}$ linear alkyl. In some embodiments, $R^2$ is $C_5$-$C_{20}$ branched alkyl. In some embodiments, $R^2$ is $C_6$-$C_{20}$ linear alkyl. In some embodiments, $R^2$ is $C_6$-$C_{20}$ branched alkyl.

3. Compositions

The compositions disclosed herein include at least one compound as described above. In some embodiments, a composition disclosed herein contains a pure composition of a compound of formula I. In other embodiments, a composition disclosed herein contains a mixture of two or more structurally distinct compounds of formula I. In some embodiments, a composition disclosed herein may contain a mixture of compounds of formulas I and II. In some embodiments, a composition disclosed herein may contain a mixture of two or more structurally distinct compounds of formula II.

In some embodiments, a composition comprises from about 20 to about 100 percent by weight of one or more compounds disclosed herein, or from about 20 to about 98 percent by weight of one or more compounds disclosed herein, or from about 50 to 97 percent by weight of one or more compounds disclosed herein.

The compositions disclosed herein can optionally include one or more additives. Suitable additives include, but are not limited to, asphaltene inhibitors, paraffin inhibitors, corrosion inhibitors, scale inhibitors, emulsifiers, dispersants, emulsion breakers, hydrogen sulfide scavengers, gas hydrate inhibitors, surfactants, solvents, and combinations thereof.

a. Asphaltene Inhibitors

Suitable asphaltene inhibitors include, but are not limited to, aliphatic sulphonic acids; alkyl aryl sulphonic acids; aryl sulfonates; lignosulfonates; alkylphenol/aldehyde resins and similar sulfonated resins; polyolefin esters; polyolefin imides; polyolefin esters with alkyl, alkylenephenyl or alkylenepyridyl functional groups; polyolefin amides; polyolefin amides with alkyl, alkylenephenyl or alkylenepyridyl functional groups; polyolefin imides with alkyl, alkylenephenyl or alkylenepyridyl functional groups; alkenyl/vinyl pyrrolidone copolymers; graft polymers of polyolefins with maleic anhydride or vinyl imidazole; hyperbranched polyester amides; polyalkoxylated asphaltenes, amphoteric fatty acids, salts of alkyl succinates, sorbitan monooleate, polyisobutylene succinic anhydride, and combinations thereof. The amount of asphaltene inhibitor present in the composition is not particularly limited and may be selected by one of ordinary skill in the art. In some embodiments, the asphaltene inhibitor may be present in the composition in an amount of about 0 to about 30% by weight of the composition.

b. Paraffin Inhibitors

Suitable paraffin inhibitors include, but are not limited to, paraffin crystal modifiers, and dispersant/crystal modifier combinations. Suitable paraffin crystal modifiers include, but are not limited to, alkyl acrylate copolymers, alkyl acrylate vinylpyridine copolymers, ethylene vinyl acetate copolymers, maleic anhydride ester copolymers, branched polyethylenes, naphthalene, anthracene, microcrystalline wax and/or asphaltenes, and combinations thereof. Suitable paraffin inhibitors also include dodecyl benzene sulfonate, oxyalkylated alkylphenols, oxyalkylated alkylphenolic resins, and combinations thereof. The amount of paraffin inhibitor present in the composition is not particularly limited and may be selected by one of ordinary skill in the art. In some embodiments, the paraffin inhibitor may be present in the composition in an amount of about 0 to about 20% by weight of the composition.

c. Corrosion Inhibitors

Suitable corrosion inhibitors include, but are not limited to, amidoamines, quaternary amines, amides, phosphate esters, and combinations thereof. The amount of corrosion inhibitor present in the composition is not particularly limited and may be selected by one of ordinary skill in the art. In some embodiments, the corrosion inhibitor may be present in the composition in an amount of about 0 to about 10% by weight of the composition.

d. Emulsifiers

Suitable emulsifiers include, but are not limited to, salts of carboxylic acids, products of acylation reactions between carboxylic acids or carboxylic anhydrides and amines, alkyl, acyl and amide derivatives of saccharides (alkyl-saccharide emulsifiers), and combinations thereof. The amount of emulsifier present in the composition is not particularly limited and may be selected by one of ordinary skill in the art. In some embodiments, the emulsifier may be present in the composition in an amount of about 0 to about 10% by weight of the composition.

e. Dispersants

Suitable dispersants include, but are not limited to, aliphatic phosphonic acids with 2-50 carbons, such as hydroxyethyl diphosphonic acid, and aminoalkyl phosphonic acids, e.g. polyaminomethylene phosphonates with 2-10 N atoms e.g. each bearing at least one methylene phosphonic acid group; examples of the latter are ethylenediamine tetra(methylene phosphonate), diethylenetriamine penta(methylene phosphonate) and the triamine- and tetramine-polymethylene phosphonates with 2-4 methylene groups between each N atom, at least 2 of the numbers of methylene groups in each phosphonate being different. Other suitable dispersion agents include lignin or derivatives of lignin such as lignosulfonate and naphthalene sulfonic acid and derivatives, and combinations thereof. The amount of dispersant present in the composition is not particularly limited and may be selected by one of ordinary skill in the art. In some embodiments, the dispersant may be present in the composition in an amount of about 0 to about 5% by weight of the composition.

f. Emulsion Breakers

Suitable emulsion breakers include, but are not limited to, dodecylbenzylsulfonic acid (DDBSA), the sodium salt of xylenesulfonic acid (NAXSA), epoxylated and propoxylated compounds, anionic cationic and nonionic surfactants, resins such as phenolic and epoxide resins, and combinations thereof. The amount of emulsion breaker present in the composition is not particularly limited and may be selected by one of ordinary skill in the art. In some embodiments, the emulsion breaker may be present in the composition in an amount of about 0 to about 10% by weight of the composition.

g. Other Hydrogen Sulfide Scavengers

Suitable other hydrogen sulfide scavengers include, but are not limited to, oxidants (e.g., inorganic peroxides such as sodium peroxide, or chlorine dioxide) and combinations thereof. The amount of other hydrogen sulfide scavengers present in the composition is not particularly limited and may be selected by one of ordinary skill in the art. In some embodiments, the other hydrogen sulfide scavengers may be present in the composition in an amount of about 0 to about 50% by weight of the composition.

h. Gas Hydrate Inhibitors

Suitable gas hydrate inhibitors include, but are not limited to, thermodynamic hydrate inhibitors (THI), kinetic hydrate inhibitors (KHI), anti-agglomerates (AA), and combinations thereof. Suitable thermodynamic hydrate inhibitors include, but are not limited to, methylethyl benzoate), and combinations thereof. Suitable kinetic hydrate inhibitors and anti-agglomerates include, but are not limited to, polymers and copolymers, polysaccharides (such as hydroxy-ethylcellulose (HEC), carboxymethylcellulose (CMC), starch, starch derivatives, and xanthan), lactams (such as polyvinylcaprolactam, polyvinyl lactam), pyrrolidones (such as polyvinyl pyrrolidone of various molecular weights), surfactants (such as fatty acid salts, ethoxylated alcohols, propoxylated alcohols, sorbitan esters, ethoxylated sorbitan esters, polyglycerol esters of fatty acids, alkyl glucosides, alkyl polyglucosides, alkyl sulfates, alkyl sulfonates, alkyl ester sulfonates, alkyl aromatic sulfonates, alkyl betaine, alkyl amido betaines), hydrocarbon based dispersants (such as lignosulfonates, iminodisuccinates, polyaspartates), amino acids, proteins, and combinations thereof. The amount of gas hydrate inhibitor present in the composition is not particularly limited and may be selected by one of ordinary skill in the art. In some embodiments, the gas hydrate inhibitor may be present in the composition in an amount of about 0 to about 5% by weight of the composition.

i. Surfactants

Suitable surfactants include, but are not limited to, anionic surfactants, cationic surfactants, nonionic surfactants, and combinations thereof. Anionic surfactants include alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialkyl sulfosuccinates and sulfosuccinamates, and combinations thereof. Cationic surfactants include alkyl trimethyl quaternary ammonium salts, alkyl dimethyl benzyl quaternary ammonium salts, dialkyl dimethyl quaternary ammonium salts, imidazolinium salts, and combinations thereof. Nonionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters, and combinations thereof. Also included are betaines and sultanes, amphoteric surfactants such as alkyl amphoacetates and amphodiacetates, alkyl amphopropripionates and amphodipropionates, alkyliminodiproprionate, and combinations thereof. The amount of surfactant present in the composition is not particularly limited and may be selected by one of ordinary skill in the art. In some embodiments, the surfactant may be present in the composition in an amount of about 0 to about 10% by weight of the composition.

j. Solvents

Suitable solvents include, but are not limited to, isopropanol, methanol, ethanol, 2-ethylhexanol, heavy aromatic naphtha, toluene, ethylene glycol, ethylene glycol monobutyl ether (EGMBE), diethylene glycol monoethyl ether, xylene, and combinations thereof. In some embodiments, the solvent is toluene. In some embodiments, the solvent is naphtha. Representative polar solvents suitable for formulation with the composition include, alcohols (including straight chain or branched aliphatic such as methanol, ethanol, propanol, isopropanol, butanol, 2-ethylhexanol, hexanol, octanol, decanol, 2-butoxyethanol, etc.), glycols and derivatives (ethylene glycol, 1,2-propylene glycol, 1,3-propylene glycol, ethylene glycol monobutyl ether, etc.), ketones (cyclohexanone, diisobutylketone), N-methylpyrrolidinone (NMP), N,N-dimethylformamide and the like. Representative of non-polar solvents suitable for formulation with the composition include aliphatics such as pentane, hexane, cyclohexane, methylcyclohexane, heptane, decane, dodecane, diesel, and the like; aromatics such as toluene, xylene, heavy aromatic naphtha, fatty acid derivatives (acids, esters, amides), and the like.

In some embodiments, the solvent is monoethyleneglycol, methanol, dimethyl sulfoxide (DMSO), dimethylformamide (DMF), tetrahydrofuran (THF), or a combination thereof.

In some embodiments, a composition disclosed herein comprises from 0 to about 80 percent by weight of one or more solvents, based on the weight of the composition. In some embodiments, a composition of the invention comprises from 0 to about 50 percent by weight of one or more solvents, based on the weight of the composition. In certain embodiments, a composition comprises 20%, 25%, 30%, 35%, 40%, 45%, or 50% by weight of one or more solvents, based on the weight of the composition.

k. Odorants

In some embodiments, a composition disclosed herein comprises an odorant such as vanillin. The amount of odorant present in the composition is not particularly limited and may be selected by one of ordinary skill in the art. In some embodiments, the odorant may be present in the composition in an amount of about 0 to about 50% by weight of the composition.

l. Additional Components

Compositions disclosed herein may further include additional functional agents or additives that provide a beneficial property. Additional agents or additives will vary according to the particular scavenging composition being manufactured and its intend use as one skilled in the art will appreciate. According to one embodiment, the scavenging compositions do not contain any of the additional agents or additives. The amount of an additional component present in the composition is not particularly limited and may be selected by one of ordinary skill in the art. In some embodiments, the additional component may be present in the composition in an amount of about 0 to about 90% by weight of the composition.

4. Methods of Use

The compounds and compositions disclosed herein may be used for sweetening a gas or liquid, such as a sour gas or a sour liquid. The compounds and compositions may be used for scavenging hydrogen sulfide and/or mercaptans from a gas or liquid stream by treating the stream with an effective amount of a compound or composition described herein. The compounds and compositions can be used in any industry where it is desirable to capture hydrogen sulfide and/or mercaptans from a gas or liquid stream. In certain embodiments, the compounds and compositions can be used in, condensate/oil systems/gas systems, or any combination thereof. In certain embodiments, the compounds and compositions can be applied to a gas or liquid produced or used in the production, transportation, storage, and/or separation of crude oil or natural gas. In some embodiments, the compounds and compositions can be applied to a gas stream used or produced in a coal-fired process, such as a coal-fired power plant. In certain embodiments, the compounds and compositions can be applied to a gas or liquid produced or used in a waste-water process, a farm, a slaughter house, a land-fill, a municipality waste-water plant, a coking coal process, or a biofuel process.

The compounds and compositions may be added to any fluid or gas containing hydrogen sulfide and/or a mercaptan, or a fluid or gas that may be exposed to hydrogen sulfide and/or a mercaptan. A fluid to which the compounds and compositions may be introduced may be an aqueous medium. The aqueous medium may comprise water, gas, and optionally liquid hydrocarbon. A fluid to which the compounds and compositions may be introduced may be a liquid hydrocarbon. The liquid hydrocarbon may be any type of liquid hydrocarbon including, but not limited to, crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, and kerosene. In some embodiments, the gas may be a sour gas. In some embodiments, the fluid or gas may be a refined hydrocarbon product.

A fluid or gas treated with a compound or composition of the invention may be at any selected temperature, such as ambient temperature or an elevated temperature. In some embodiments, the fluid (e.g., liquid hydrocarbon) or gas may be at a temperature of from about 40° C. to about 250° C. In some embodiments, the fluid or gas may be at a temperature of from −50° C. to 300° C., 0° C. to 200° C., 10° C. to 100° C., or 20° C. to 90° C. In some embodiments, the fluid or gas may be at a temperature of 22° C., 23° C., 24° C., 25° C., 26° C., 27° C., 28° C., 29° C., 30° C., 31° C., 32° C., 33° C., 34° C., 35° C., 36° C., 37° C., 38° C., 39° C., or 40° C. In some embodiments, the fluid or gas may be at a temperature of 85° C., 86° C., 87° C., 88° C., 89° C., 90° C., 91° C., 92° C., 93° C., 94° C., 95° C., 96° C., 97° C., 98° C., 99° C., or 100° C.

The fluid or gas in which the compounds and compositions are introduced may be contained in and/or exposed to many different types of apparatuses. For example, the fluid or gas may be contained in an apparatus that transports fluid or gas from one point to another, such as an oil and/or gas pipeline. In certain embodiments, the apparatus may be part of an oil and/or gas refinery, such as a pipeline, a separation vessel, a dehydration unit, or a gas line. The fluid may be contained in and/or exposed to an apparatus used in oil extraction and/or production, such as a wellhead. The apparatus may be part of a coal-fired power plant. The apparatus may be a scrubber (e.g., a wet flue gas desulfurizer, a spray dry absorber, a dry sorbent injector, a spray tower, a contact or bubble tower, or the like). The apparatus may be a cargo vessel, a storage vessel, a holding tank, or a pipeline connecting the tanks, vessels, or processing units. In certain embodiments, the fluid or gas may be contained in water systems, condensate/oil systems/gas systems, or any combination thereof.

The compounds or compositions may be introduced into a fluid or gas by any appropriate method for ensuring dispersal of the scavenger through the fluid or gas. The compounds and compositions may be injected using mechanical equipment such as chemical injection pumps, piping tees, injection fittings, atomizers, quills, and the like. The compounds and compositions of the invention may be introduced with or without one or more additional polar or non-polar solvents depending upon the application and requirements. In some embodiments, the compounds and compositions may be pumped into an oil and/or gas pipeline using an umbilical line. In some embodiments, capillary injection systems can be used to deliver the compounds and compositions to a selected fluid. In some embodiments, the compounds and compositions can be introduced into a liquid and mixed. In some embodiments, the compounds and compositions can be injected into a gas stream as an aqueous or nonaqueous solution, mixture, or slurry. In some embodiments, the fluid or gas may be passed through an absorption tower comprising a compound or composition.

The compounds and compositions may be applied to a fluid or gas to provide a scavenger concentration of about 1 parts per million (ppm) to about 1,000,000 ppm, about 1 parts per million (ppm) to about 100,000 ppm, about 10 ppm to about 75,000 ppm, about 100 ppm to about 45,000 ppm, about 500 ppm to about 40,000 ppm, about 1,000 ppm to about 35,000 ppm, about 3,000 ppm to about 30,000 ppm, about 4,000 ppm to about 25,000 ppm, about 5,000 ppm to about 20,000 ppm, about 6,000 ppm to about 15,000 ppm, or about 7,000 ppm to about 10,000 ppm. The compounds and compositions may be applied to a fluid at a concentration of about 100 ppm to about 2,000 ppm, about 200 ppm to about 1,500 ppm, or about 500 ppm to about 1000 ppm. Each system may have its own requirements, and a more sour gas (e.g., containing more hydrogen sulfide) may require a higher dose rate of a compound or composition. In some embodiments, the compounds and compositions may be applied to a fluid or gas in an equimolar amount or greater relative to hydrogen sulfide and/or mercaptans present in the fluid or gas. In some embodiments, the compounds and compositions may be applied to a fluid or gas as a neat composition (e.g., the compounds and compositions may be used neat in a contact tower).

The hydrogen sulfide and/or mercaptan in a fluid or gas may be reduced by any amount by treatment with a compound or composition. The actual amount of residual hydrogen sulfide and/or mercaptan after treatment may vary depending on the starting amount. In some embodiments, the hydrogen sulfide and/or mercaptan levels may be reduced to about 150 ppm by volume or less, as measured in the vapor phase, based on the volume of the liquid media. In some embodiments, the hydrogen sulfide levels and/or mercaptan may be reduced to 100 ppm by volume or less, as measured in the vapor phase, based on the volume of the liquid media. In some embodiments, the hydrogen sulfide and/or mercaptan levels may be reduced to 50 ppm by volume or less, as measured in the vapor phase, based on the volume of the liquid media. In some embodiments, the hydrogen sulfide and/or mercaptan levels may be reduced to 20 ppm by volume or less, as measured in the vapor phase, based on the volume of the liquid media. In some embodiments, the hydrogen sulfide and/or mercaptan levels may be reduced to 15 ppm by volume or less, as measured in the vapor phase, based on the volume of the liquid media. In some embodiments, the hydrogen sulfide and/or mercaptan levels may be reduced to 10 ppm by volume or less, as measured in the vapor phase, based on the volume of the liquid media. In some embodiments, the hydrogen sulfide and/or mercaptan levels may be reduced to 5 ppm by volume or less, as measured in the vapor phase, based on the volume of the liquid media. In some embodiments, the hydrogen sulfide and/or mercaptan levels may be reduced to 1 ppm by volume, as measured in the vapor phase, based on the volume of the liquid media. In some embodiments, the hydrogen sulfide and/or mercaptan levels may be reduced to 0 ppm by volume, as measured in the vapor phase, based on the volume of the liquid media.

In certain embodiments, a water wash may be added in an amount suitable for forming an emulsion with a hydrocarbon. In certain embodiments, the water wash may be added in an amount of from about 1 to about 50 percent by volume based on the volume of the emulsion. In certain embodiments, the wash water may be added in an amount of from about 1 to about 25 percent by volume based on the volume of the emulsion. In certain embodiments, the wash water may be added in an amount of from about 1 to about 10 percent by volume based on the volume of the emulsion. In certain embodiments, the amount of hydrocarbon may be present in an amount of from about 50 to about 99 percent by volume based on the volume of the emulsion. In some embodiments, the hydrocarbon may be present in an amount of from about 75 to about 99 percent by volume based on the volume of the emulsion. In some embodiments, the hydrocarbon may be present in an amount of from about 90 to about 99 percent by volume based on the volume of the emulsion.

The water wash and hydrocarbon may be emulsified by any conventional manner. In some embodiments, the water wash and hydrocarbon may be heated and thoroughly mixed to produce an oil-in-water emulsion. In certain embodiments, the water wash and hydrocarbon may be heated at a temperature in a range of from about 90° C. to about 150° C. The water wash and hydrocarbon may be mixed in any conventional manner, such as an in-line static mixer or an in-line mix valve with a pressure drop of about 0.2 to about 2 bar depending on the density of the hydrocarbon. The emulsion may be allowed to separate, such as by settling, into an aqueous phase and an oil phase. In certain embodiments, the aqueous phase may be removed. In another embodiment, the aqueous phase may be removed by draining the aqueous phase.

Optionally, demulsifiers may be added to aid in separating water from the hydrocarbon. In certain embodiments, the demulsifiers include, but are not limited to, oxyalkylated organic compounds, anionic surfactants, nonionic surfactants or mixtures of these materials. The oxyalkylated organic compounds include, but are not limited to, phenol-formaldehyde resin ethoxylates and alkoxylated polyols. The anionic surfactants include alkyl or aryl sulfonates, such as dodecylbenzenesulfonate. These demulsifiers may be added in amounts to contact the water from about 1 to about 1000 ppm by weight based on the weight of the hydrocarbon.

The compounds, compositions, methods, and processes will be better understood by reference to the following examples, which are intended as an illustration of and not a limitation upon the scope of the invention.

5. Examples

Example 1

The performance of the condensation product of 2-ethyl hexanol and formaldehyde (2-ethylhexyl hemiformal) was examined at 25° C. This test, a modification of ASTM D5705, was carried out by adding 500 mL of $H_2S$ laden naphtha, to a 1 L bottle. The bottle was sealed and shaken vigorously for about 20 seconds. The vapor phase $H_2S$ concentration was then measured by removing the cap and affixing a rubber stopper with a $H_2S$ gas detection tube (Draeger brand) traversing through the stopper. Once the baseline $H_2S$ concentration was determined, scavengers were added individually to 1 L bottles, and then the hydrocarbon (500 mL) was added and the bottle sealed. It was noted that the hemiformal was miscible in the naphtha.

The bottles containing the naphtha and scavengers were shaken vigorously for about 20 seconds and allowed to stand for 2 hours. The vapor phase $H_2S$ concentration was measured for each bottle by the above method. The results of these experiments are shown in Table I.

TABLE I

| Entry | Scavenger | Liquid [Scavenger]/ ppm | Vapor [$H_2S$] after 2 h/ppm |
|---|---|---|---|
| 1 | Untreated | 0 | 1400 |
| 2 | 2-ethyl hexanol hemiformal | 900 | 800 |
| 3 | 2-ethyl hexanol hemiformal | 1200 | 600 |

Example 2

The performance of the condensation of tridecanol and formaldehyde (tridecanol hemiformal) was tested at 25° C. This test, a modification of ASTM D5705, was carried out by adding 500 mL of $H_2S$ laden naphtha, to a 1 L bottle. The bottle was sealed and shaken vigorously for about 20 seconds. The vapor phase $H_2S$ concentration was then measured by removing the cap and affixing a rubber stopper with a $H_2S$ gas detection tube (Draeger brand) traversing through the stopper. Once the baseline $H_2S$ concentration was determined, scavengers were added individually to new 1 L bottles, and then the hydrocarbon (500 mL) was added and the bottle sealed. At this point it was noted that hemiformal was miscible in the naphtha.

The bottles containing the naphtha and scavengers were shaken vigorously for about 20 seconds and allowed to stand for 2 hours. The vapor phase $H_2S$ concentration was measured for each bottle by the above method. The results of these experiments are shown in Table II.

TABLE II

| Entry | Scavenger | Liquid [Scavenger]/ ppm | Vapor [$H_2S$] after 2 h/ppm |
|---|---|---|---|
| 1 | Untreated | 0 | 1575 |
| 2 | Tridecanol hemiformal | 1050 | 700 |
| 3 | Tridecanol hemiformal | 1400 | 400 |

Without wishing to be bound to any theory, it is believed that the hemiformals' increased miscibility in the hydrocarbon contributes to its improved sulfide scavenging activity. In contrast, glyoxal's sulfide scavenging activity is lower because of its poor oil solubility. This hypothesis was tested using the above method and the results are shown in Tables III and IV.

TABLE III

| Entry | Scavenger | Liquid [Scavenger]/ ppm | Vapor [$H_2S$] after 2 h/ppm |
|---|---|---|---|
| 1 | Untreated | 0 | 1575 |
| 2 | Tridecanol hemiformal | 1400 | 400 |
| 3 | Glyoxal | 1400 | 550 |

TABLE IV

| Entry | Scavenger | Liquid [Scavenger]/ ppm | Vapor [$H_2S$] after 2 h/ppm |
|---|---|---|---|
| 1 | Untreated | 0 | 1525 |
| 2 | Isobutyl hemiformal | 636 | 750 |
| 3 | Glyoxal | 636 | 1190 |

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. Any and all patents, patent applications, scientific papers, and other references cited in this application, as well as any references cited therein, are hereby incorporated by reference in their entirety.

What is claimed is:

1. A method of sweetening a fluid, comprising:

treating the fluid with an oil-soluble hemiformal of formula (I):

$$R^1—O—[—CH_2—O—]_x—H; \quad (I)$$

wherein $R^1$ is $C_8$-$C_{30}$ linear or branched alkyl;

x is from 1 to 105;

and sweetening the fluid, wherein the fluid is selected from the group consisting of crude oil, naphtha, fuel, distillate oils, and any combination thereof.

2. The method of claim 1, wherein x is from 1 to 12.

3. The method of claim 1, wherein x is from 1 to 5.

4. The method of claim 1, wherein x is 1.

5. The method of claim 1, wherein x is 2.

6. The method of claim 1, wherein $R^1$ is linear $C_8$-$C_{30}$ alkyl.

7. The method of claim 1, wherein $R^1$ is branched $C_8$-$C_{30}$ alkyl.

8. The method of claim 1, wherein $R^1$ is tridecyl.

9. The method of claim 1, wherein $R^1$ is 2-ethylhexyl.

10. The method of claim 1, wherein the fluid is treated with formula (I) and an aldehyde compound of formula (II);

$$R^2—(CO)H; \quad (II)$$

wherein $R^2$ is $C_4$-$C_{30}$ linear or branched alkyl.

11. The method of claim 10, wherein $R^2$ is linear $C_4$-$C_{20}$ alkyl.

12. The method of claim 10, wherein $R^2$ is branched $C_4$-$C_{20}$ alkyl.

13. The method of claim 1, further comprising adding one or more additional components, each component independently selected from the group consisting of asphaltene inhibitors, paraffin inhibitors, corrosion inhibitors, emulsifiers, water clarifiers, dispersants, emulsion breakers, hydrogen sulfide scavengers, gas hydrate inhibitors, surfactants, dispersant, solvents, and combinations thereof.

14. The method of claim 13, wherein the surfactant or dispersant is selected from the group consisting alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

15. The method of claim 1, further comprising adding an odorant.

* * * * *